United States Patent [19]

Grinneiser

[11] Patent Number: 4,586,031

[45] Date of Patent: Apr. 29, 1986

[54] INFRA-SONIC DETECTOR, AND ALARMS INCLUDING SAME

[75] Inventor: Raymond Grinneiser, Nice, France

[73] Assignee: Electronique Guglielmetti V.G. Electronique, Nice, France

[21] Appl. No.: 530,423

[22] Filed: Sep. 8, 1983

[30] Foreign Application Priority Data

Mar. 12, 1982 [FR] France ..... 82 04464

[51] Int. Cl.[4] ..... G08B 13/22

[52] U.S. Cl. ..... 340/566; 340/614

[58] Field of Search ..... 340/566, 614

[56] References Cited

U.S. PATENT DOCUMENTS 3,854,129 12/1974 Haselton .
4,307,387 12/1981 Baxendale ..... 340/566
4,455,631 6/1984 San Giovanni ..... 340/566
4,468,763 8/1984 Braunling et al. ..... 340/566

FOREIGN PATENT DOCUMENTS 687478 3/1967 Belgium .
972292 1/1951 France .

*Primary Examiner*—Glen R. Swann, III
*Attorney, Agent, or Firm*—Young & Thompson

[57] ABSTRACT

A volumetric infra-sonic pick-up may be used in various combinations to form an infra-sonic or low-frequency alarm and intrusion detector. The detection device for alarm, surveillance and/or monitoring comprises an infra-sonic pick-up (1) below the sonic frequency range. The infra-sonic pick-up (1) comprises means acting as a pressure or pressure variation pick-up (2), an amplifier (3), and a filter which eliminates the audio or higher frequency signals. The pressure pick-up (2) is a microphone.

7 Claims, 3 Drawing Figures

INFRA-SONIC DETECTOR, AND ALARMS INCLUDING SAME

FIELD OF THE INVENTION

This invention relates to infra-sonic detectors in particular a perimeter detector which may be used in various combinations to form an infra-sonic or low-frequency intrusion detector and alarm.

BACKGROUND OF THE INVENTION

Numerous detector devices, and particularly alarms, make use of ultrasonics, i.e. very high frequencies. These devices have both advantages and disadvantages. The disadvantages include the possibility of accidental triggering and poor detector specificity, gradual detection being difficult. Consequently, ultrasonic or very high frequency detectors are used to provide protection for an empty room or flat in which nothing can move whilst this type of detector is in operation without the movement being detected.

This invention aims to alleviate or overcome the disadvantages noted above.

SUMMARY OF THE INVENTION

According to this invention there is provided a detector device for a surveillance and/or monitoring alarm, which device includes a passive non-mechanical infra-sonic pick-up. The infra-sonic pick-up may comprise means acting as a pressure or pressure-variation pick-up (other than a manometric chamber), and with advantage comprises a microphone or any other type of relative or absolute pressure pick-up. The pick-up may be of piezo-electric, dynamic, condenser or electromagnetic type so formed that it responds only to infra-sonic vibrations. The detector further comprises signal processing means comprising digital and/or analog correlation, combination and/or comparison between frequency bands and/or signal amplitudes.

An infra-sonic detector embodying the invention can monitor a room, a flat, or other premises with one or more articles and/or people in motion. An alarm can be given in premises containing articles or people in motion. A detector embodying the invention can therefore be a direct replacement for ultrasonic radars and infra-red or very high frequency detectors in cases in which the latter are used solely to detect intrusion into a given space, or any other variation thereof. A detector embodying the invention may replace any ultrasonic or very high frequency radar device at a much lower cost (both for survey and for production—through cheap electronics, very simple signal processing by filtration, no need for adjustment, and so on).

A detector device embodying the invention comprises a means acting as a pick-up for pressure or some other parameter and adapted to respond to atmospheric pressure variations of the order of one-tenth of a microbar approximately. The information detected by the pressure pick-up is then filtered to retain only the original infra-sonic signals below 20 Hz. These signals are amplified by an amplifier. Studies by the inventors have distinguished five or more frequency bands in the effective range:

A. Band 1: below 0.3 Hz
B. Band 2: from 0.3 to 0.7 Hz
C. Band 3: from 0.7 to 1.8 Hz
D. Band 4: from 1.8 to 4.5 Hz E. Band 5: above 4.5 Hz.

The volumetric pressure pick-up may be associated with A, B and C band filters and be used to activate any conventional alarm system (e.g. a siren, illumination, and so on).

BRIEF DESCRIPTION OF THE DRAWING

A preferred embodiment of the invention is now described with reference to the accompanying drawings in which.

DETAILED DESCRIPTION OF THE INVENTION

Figures 1, 2:
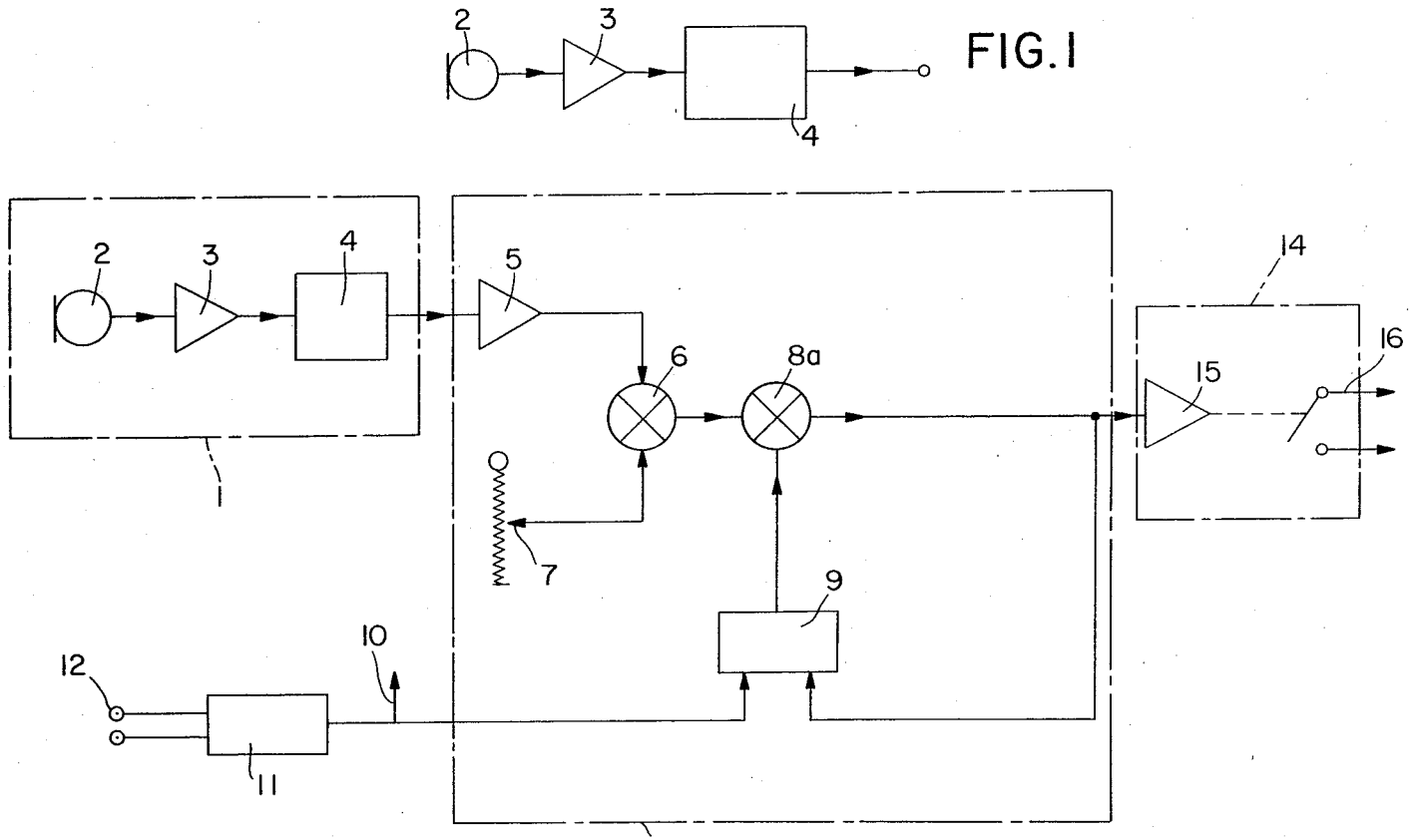
FIG. 1 is a diagram illustrating the infra-sonic detector.
FIG. 2 is a general view of the system comprising the infra-sonic detector, the signal processing stage and its use as an alarm.

An infra-sonic detector 1 embodying the invention comprises a microphone 2, an amplifier 3, and a low-frequency filter 4.

The signal from detector 1 is fed to unit 8 in which it is processed. Unit 8 includes means acting as a detector and filter 5, and passes an output signal to a comparator 6.

The sensitivity of comparator 6 can be adjusted by variation of a setting means 7, and its output signal is fed to a blocking circuit 8*a* to which is connected a start and re-set switch 9 in a general supply circuit 10. The supply comprises a rectifier/stabilizer 11 coupled to a mains supply 12. The signal from circuit 8*a* is passed to a unit 14 comprising an amplifier 15 and a utilization relay 16.

It will be apparent that the different bands used as a result of the study enable a distinction to be made, thus obviating false alarms due to the use conditions and conditions outside the pick-up 1.

EXAMPLE 1

Anti-theft protection on a motor vehicle

In this case the pick-up 1 may comprise a microphone 2 or any other detector associated with a band filter. The processed signal can be correlated or combined with other signals from other-band filters. The result of this processing enables a conventional alarm to be triggered accurately.

The use of the B and C bands obviates any difficulties from very slow pressure variations (temperature rise of a vehicle situated in full sunlight, change from daytime to nightime conditions, and so on) and fast variations (e.g. infra-sonics of the frequencies of bands D and E produced by a vehicle passing nearby).

On the other hand, the pick-up 1 effectively detects any infra-sonic vibrations produced by opening a door or breaking a window.

EXAMPLE 2

Figure 3:
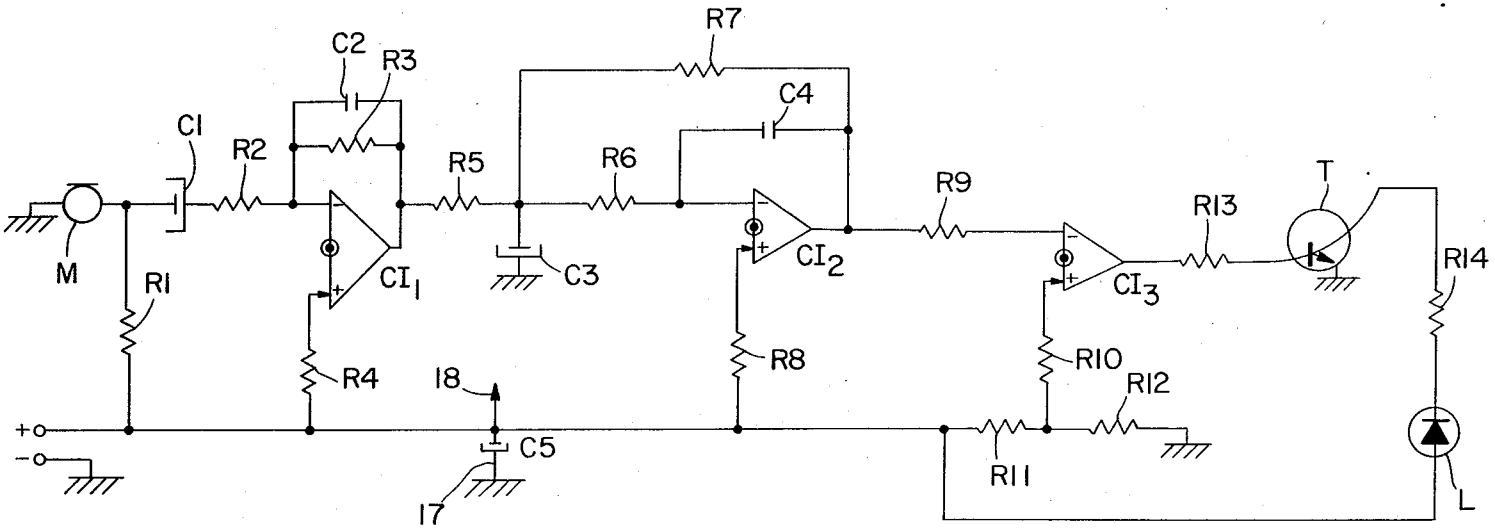
FIG. 3 illustrates an integrated circuit used in the system.

The circuit shown in FIG. 3 detects the opening of a door in closed premises.

This circuit shows the efficiency of the system and the infra-sonic frequencies of bands B and C produced by the opening of a door in a closed room.

In this case the detector comprises the microphone M and the amplifiers $CI_1$ and $CI_2$.

Amplifier $CI_3$ compares the voltage with a fixed reference and enables an LED L to light up.

This type of circuit provides detection up to 200 $m^2$ in a radius of 50 m.

The integrated circuit used is a Norton quadruple amplifier, which can be replaced by any other type of operational amplifier, or by discrete components.

The component valves in FIG. 3 are as follows:

| | | | |
|---|---|---|---|
| R1 = 2.7K | | R8 = 1.1 M Ω | |
| R2 = 10K | | R9 = 1 M Ω | |
| R3 = 1 M Ω | | R10 = 1 M Ω | |
| R4 = 2 M Ω | | R11 = 1.2K | |
| R5 = 390K | | R12 = 1K | |
| R6 = 390K | | R13 = 47K | |
| R7 = 390K | | R14 = 1.2K | |
| C1 = 47 | MF. tantalum | | |
| C2 = 100 | nf. | | |
| C3 = 0.47 | MF. tantalum | | |
| C4 = 100 | nf. | | |
| C5 = 10 | MF. | | |

$CI_1$ $CI_2$ $CI_3$=¾ MC 3301 P (Manufacturer:-MOTOROLA).

M=electret EM 80 (manufacturer: L.E.M.)

T=Any NPN type 2N 2222

L=Any 10 mA LED

Feed=9 to 12 V d.c. power supply (17) and (18): Integrated circuit supply pins.

The invention has numerous possibilities and industrial applications:

(a) Volumetric detectors for anti-theft and anti-intrusion alarms;

(b) Passage detectors using infra-sonic frequencies of certain bands produced by an air movement;

(c) Opening detectors; in which case a pick-up installed in a room eliminates the need for any contacts on doors and windows of the room (wiring is simplified);

(d) Shock detector. The infra-sonic frequencies produced by vibration of a wall are in the high infra-sonic bands.

I claim:

1. A passive intrusion detector and alarm device comprising in electrical series:

an infrasonic detector (1) comprising:

a pressure pick-up (2) adapted for sensing pressure variations occurring in the atmosphere of the space to be monitored, and producing a corresponding electric pressure signal;

amplifier means (3) for amplifying said pressure signal;

low-pass filter means (4) for retaining only infrasonic signals from the signals delivered by said amplifier means;

threshold means (6) for comparing the signal from said low-pass filter means to a fixed reference thereby delivering a trigger signal; and alarm means (14) activated by said trigger signal.

2. The device of claim 1, in which the low-pass filter means is adapted to retain only signals below 20 Hz.

3. The device of claim 2, in which the low-pass filter means is adapted to retain only signals below 1.8 Hz.

4. The device of claim 1, including sensitivity adjusting means (7) for setting said fixed reference of said threshold means.

5. The device of claim 1, in which the sensitivity of said pressure pick-up is of the order of 0.1 μbar.

6. The device of claim 1, in which said pressure pick-up is a microphonic pick-up.

7. The device of claim 6, in which said microphonic pick-up is an electret microphone.

* * * * *